United States Patent [19]

Ludwig

[11] Patent Number: 4,609,121

[45] Date of Patent: Sep. 2, 1986

[54] SAFETY CLOSURE CAP

[75] Inventor: Clifford J. Ludwig, Southgate, Ky.

[73] Assignee: The Drackett Company, Cincinnati, Ohio

[21] Appl. No.: 771,533

[22] Filed: Aug. 30, 1985

[51] Int. Cl.[4] ..... B65D 53/00

[52] U.S. Cl. ..... 220/234; 220/235; 220/307; 215/212; 215/213

[58] Field of Search ..... 215/211, 212, 213, 358, 215/360, 364, 224, 225; 220/234, 233, 235, 307

[56] References Cited

U.S. PATENT DOCUMENTS

| | | | |
|---|---|---|---|
| 165,962 | 7/1875 | Stevens et al. . | |
| 1,436,052 | 11/1922 | Peacock . | |
| 3,133,666 | 5/1964 | Henchert | 220/307 |
| 3,703,975 | 11/1972 | Wittemer | 215/213 |
| 3,820,675 | 6/1974 | Malles | 215/212 |
| 4,043,474 | 8/1977 | McCord | 215/211 |
| 4,315,578 | 2/1982 | Ludwig | 215/211 |
| 4,401,225 | 8/1983 | Schwaikert | 215/211 |
| 4,516,683 | 5/1985 | Delia | 215/211 |

*Primary Examiner*—George T. Hall
*Attorney, Agent, or Firm*—Charles J. Zeller

[57] ABSTRACT

A child resistant container construction. The dispensing opening of the container is normally closed by a plug having a pull tab thereon. The plug is removable and reinsertable in the dispensing opening. The plug is formed so that it is distortable. A rigid, rotary locking member is carried by the plug. In one angular position on the plug, the locking member prevents distortion of the plug and thereby prevents plug removal. In a second angular position on the plug, the locking member permits distortion of the plug upon pulling the pull tab, thereby permitting its removal from the dispensing opening. In other embodiments, the locking member can be completely removed from the plug to permit plug distortion and removal.

10 Claims, 5 Drawing Figures

SAFETY CLOSURE CAP

This invention relates to a child resistant plug and container construction of the type used to package medicaments and certain household products and chemicals which could be dangerous to health upon their ingestion. In general, such container constructions are designed so as to be readily openable by adults, yet too complex to be opened by children too young to understand the dangers attendant medicaments or inherently harmful substances such as bowl cleaners, anti-freeze compounds and the like.

According to the practice of this invention, a container, such as a cylindrical container, is closed at at least one end by a disc closure. The disc closure is provided with a dispensing opening, the opening normally closed by a plug, the plug being provided with a radially outwardly extending pull tab, preferably integral with the plug. The plug is so fashioned that it can be flexed or distorted upon pulling the pull tab upwardly and away from the interior of the container, such that the plug can be removed from the dispensing opening, to thereby gain access to the contents of the container. The plug carries a rigid locking or stiffener member which acts to preclude distortion in a certain direction of the plug upon pulling the pull tab, yet which will permit the desired distortion, in the desired direction, upon stiffener orientation in another direction. In variations of the invention, the locking or stiffener member can be temporarily removed from the plug, to thereby permit the desired distortion.

The prior art is aware of constructions somewhat similar to the present construction. For example, U.S. Pat. No. 4,401,225 issued to Schwaikert shows a distortable or flexible plug carrying an integral pull tab, with distortion of the plug being necessary to permit flexing and subsequent removal of the plug. The prior art is also aware of U.S. Pat. No. 1,436,052 issued to Peacock. This patent discloses a box or container wherein a foldable lid fits into the opening between an inner annular flange and outer diametrically opposed projections. Rotation of the lid when in place brings the fold beneath the upper projections, thereby restricting plug removal. U.S. Pat. No. 3,703,975 issued to Wittemer discloses a safety closure comprising a core and flexible deformable base having a downwardly opening chamber or skirt that fits over the container mouth and neck and an upwardly open skirt to receive the core. The core is rotatable between "lock" and "unlock" positions. In the "unlock" position, the cap may be deformed by squeezing to retract radial projections on the inside of the lower skirt from engagement with the container, permitting removal of the cap. In the "lock" position, such deformation is prevented. U.S. Pat. No. 3,133,666 issued to Henchert discloses a closure plug of formable resilient material shaped at its periphery to engage snuggly an opening in a container, the closure portion being convexed inwardly of the plane of the opening. As shown in the Henchart patent, the closure portion of the closure plug may be provided with intersecting ribs in order to reinforce the closure portion.

Additionally, U.S. Pat. No. 4,043,474 issued to McCord discloses a plug having a radially extending pull tab, the pull tab requiring rotation to a certain angular position to permit its withdrawal or removal from the dispensing opening.

The present invention differs from known constructions of this general type in that the present construction includes a rigid locking or stiffening member, thereby even more positively preventing deformation or flexing of the plug by a child with consequent plug removal. In one embodiment, the locking member is rotatively and non-removably carried by the plug. In other embodiments, the locking member is removable from the plug upon locking member rotation, enabling the plug to be flexed or deformed to remove it from the dispensing opening, and the locking member then replaced after the plug has been reinserted into the dispensing opening.

IN THE DRAWINGS

Figure 1:
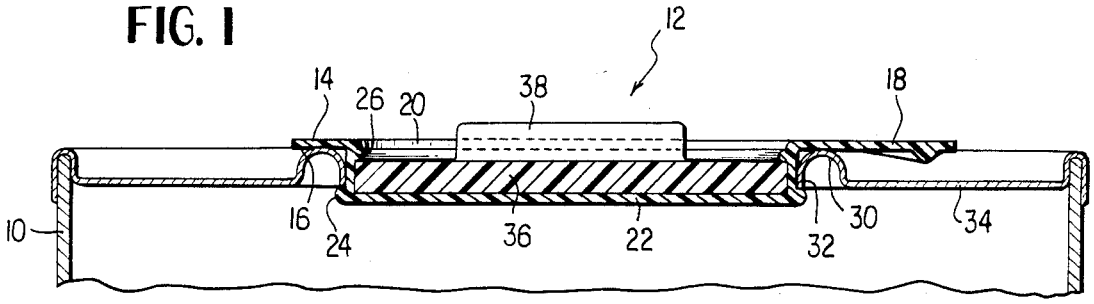
FIG. 1 is a partial cross-sectional view showing the upper portion of a container provided with the deformable child resistant plug of this invention.

Referring now to FIG. 1 of the drawings, the cross-section of the upper portion of a tubular container provided with the child resistant container plug of this invention is illustrated. The numeral 10 denotes the side walls of the container, the side walls fashioned from paperboard for example, the container being of conventional construction and having a disc closure at the illustrated end. The numeral 12 denotes generally the child resistant plug construction of this invention. The plug is also shown, in perspective, at FIG. 2 of the drawings. The plug is fashioned of polyethylene, PVC, polypropeylene, or like resilient, deformable materials. The numeral 14 denotes a rim of continuous annular extent, the lower portion of the rim being denoted by the numeral 16. The numeral 18 denotes a manually graspable lift or pull tab, preferably integral with the plug. The numeral 20 denotes the circular interior side wall of the plug, while numeral 22 denotes the bottom or innermost closure or bottom portion of the plug. A rim 24, preferably integral with bottom portion 22, extends radially outwardly of the exterior portion of interior wall 20. The numeral 26 denotes an annularly continuous retaining rib, preferably integrally molded with the plug and spaced from plug bottom 22.

The numeral 30 denotes an annularly continuous rim around the opening on the container disc closure, the rim being of generally convex form in transverse cross-section, with the radially innermost portion of rim 30 terminating in edge 32. The radially outermost portions of the container top closure disc are denoted by the numeral 34. The upper rim or edge of container side wall 10 is conventionally secured to the radially outermost portion of the upper container closure disc, such as by means of a double seam.

The numeral 36 denotes a stiffening or a locking member of generally rectangular form, typically formed of a hard plastic material. Locking member 36 is preferably provided with an upwardly extending and manually graspable handle 38. The function of retaining rib 26 is to maintain locking member 36 in place, so that it always remains with plug 12 and is rotatable within it. The tips or ends of the locking member are held between rib 26 and plug bottom 22.

In the position of FIG. 1, the plug is held against upward movement by rim 24 bearing against edge 32, and is held against downward movement by rim 14 bearing against rim 30.

The mode of operation of this embodiment of the invention will now be described.

Figure 2:
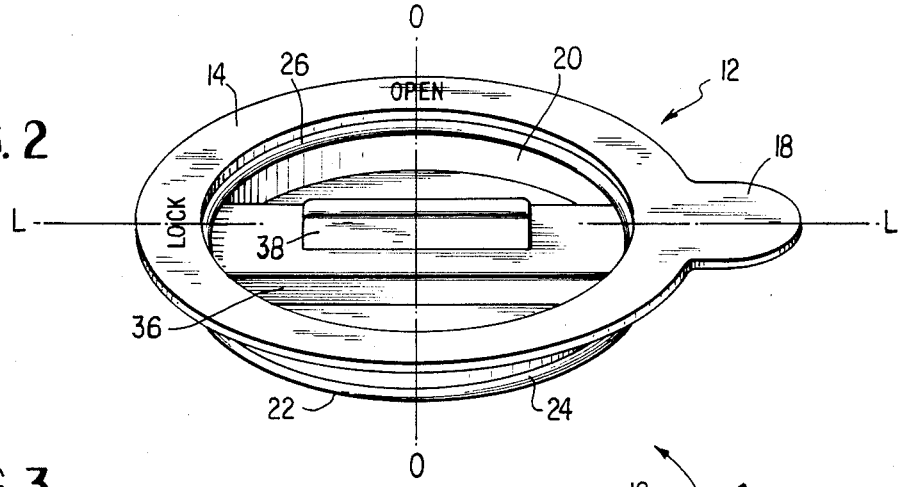
FIG. 2 is a perspective view of the child resistant plug construction shown at FIG. 1.
Figure 3:
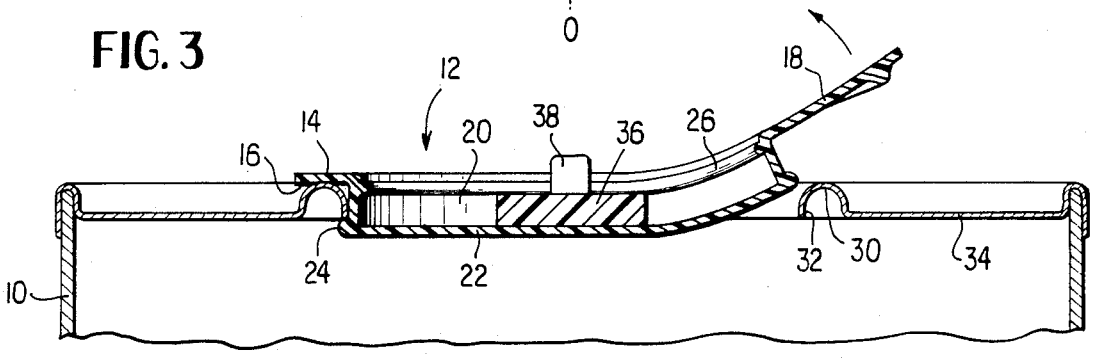
FIG. 3 is a view similar to FIG. 1 and illustrated the removal of the plug by distorting it.

Referring now also to FIG. 3, when the locking or stiffening member 36 is in a position aligned with axis L—L of FIG. 2, upward pulling of pull tab 18 (as indicated by the arrow at FIG. 3) will not permit distortion of plug 12. The plug will not be removable from the dispensing opening by pulling the tab.

When the locking member 36 is rotated to its open position, such that the longitudinal axis of locking member 36 is parallel to axis O—O of FIG. 2, upward pulling of pull tab 18 will result in a distortion of plug 12 about an axis parallel to axis O—O. This distortion will be so pronounced as to permit the removal of plug 12, as indicated in FIG. 3 of the drawings. Locking axis L—L is coincident with the radial direction of pull tab 18, and axes O—O and L—L are 90° apart. In practice, locking member 36 should always be aligned with either one of the two axes O—O and L—L. Clearly, the flexibility of the plug, when pull tab 18 is pulled, will vary from a minimum at axis L—L to a maximum as axis O—O.

While shown as flat and of uniform thickness, the rim 14 of the plug may be thickened so as to assume a form generally square in transverse cross-section. Further, the lower surface of rim 14 may be made concave to match the upper contour of rim 30 around the dispensing opening. Such a thickened rim may be provided with a continuous groove or valley extending from its upper surface towards its lower surface.

Figure 4:
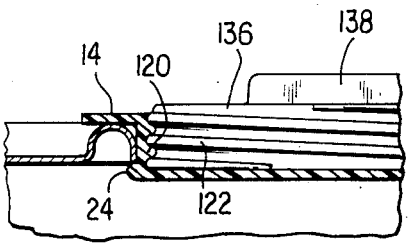
FIG. 4 is a partially cross-sectional view, similar to FIG. 1, and shows a modification wherein the locking member can be removed from the deformable plug by unscrewing it.

Referring now to the embodiment illustrated at FIG. 4 of the drawings, the general construction and shape of the locking plug 12 is the same, except that the locking or stiffening member, here denoted by the numeral 136, is cylindrical and carries threads 122 which mate with corresponding internal threads 120 molded on the interior wall 20 of the plug. Thus, threads 120 of the embodiment of FIG. 4 correspond in location to retaining rim 26 of the embodiment of FIG. 1. In order to remove the locking plug in the embodiment of FIG. 4 from the container, to thereby dispense the contents thereof, the retaining or locking member 136 is unscrewed by rotating handle 138 attached to it and the pull tab 18 pulled upwardly, thereby permitting deformation or flexing of the plug and its subsequent removal from the dispensing opening. After the desired amount of the contents of the container have been dispensed, the plug is replaced into the container dispensing opening and stiffening or locking member 136 screwed back in place.

Figure 5:
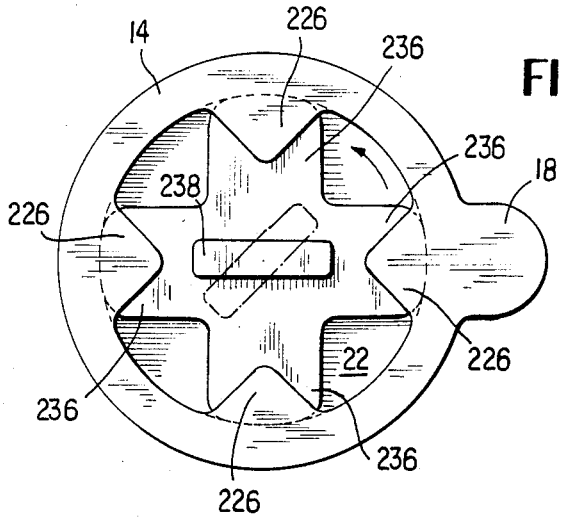
FIG. 5 is a top view of a plug and container, similar to FIG. 1, showing a modification wherein the rigid locking or stiffening member can be temporarily removed by twisting it approximately 45 degrees from its plug locking position.

Referring now to FIG. 5 of the drawings, another modification is disclosed, similar to that of FIG. 4, in the sense that the stiffening or locking member is completely temporarily removable from the plug. The stiffening or locking member of the embodiment of FIG. 5 is generally in the form of a cross having angularly spaced arms 236 and is also provided with a manually graspable handle 238. Four radially inwardly projecting abutment or retaining members 226, integral with the plug and corresponding to retaining rim 26 of the embodiment of FIG. 1, are disposed on inner wall 20 of the plug at equal angular positions. The angular width between retaining members 226 is less than the angular width between the radially outwardly directed arms 236 of retaining member. The mode of operation is such that in the locked position, the retaining members 226 overlie the tips of the four arms 236, the stiffening member being generally flat and resting on plug bottom wall 22. In this position, the plug cannot be removed from the dispensing opening by pulling tab 18. In order to remove the plug, handle 238 is manually grapsed and the retaining member twisted, in either direction, approximately 45 degrees. This will place the tips of arms 236 in the angularly disposed spaces between retaining members 226. In this angular position, the stiffening member can be lifted and removed from the plug. Pulling on pull tab 18 will now result in a flexing or distorting of the plug, such that the plug can be removed from the dispensing opening. After dispensing, the plug is replaced in the dispensing opening and retaining member replaced by a reversal of the steps mentioned. The advantage of the embodiment of FIG. 5 is that it is very nearly impossible to remove the retaining member from the dispensing opening of the container, even if flange 14 is pulled upwardly at a point 90° in either direction, from the location of pull tab 18. The same is true with respect to the embodiment of FIG. 4.

What is claimed is:

1. A child resistant container construction, the combination of a container having a dispensing opening, a plug formed of flexible material, the plug having a peripheral lip normally engaging a portion of the internal rim of the dispensing opening to normally prevent the plug from being withdrawn from the dispensing opening in a direction away from the container interior, means carried by the plug to prevent its complete entry into the interior of the container, the plug having a radially disposed, manually graspable, lift tab carried by the plug, a locking member of a rigid material rotatably and non-removably mounted in the plug, the locking member normally having its longitudinal axis aligned with the lift tab to thereby prevent the plug from distorting sufficiently to allow its withdrawal from the dispensing opening upon pulling of the lift tab away from the container interior, the locking member being rotatable to a position where said axis is generally at right angles to the lift tab to thereby permit the plug to distort sufficiently to allow it to be withdrawn upon pulling of the lift tab away from the container interior.

2. The child resistant container construction of claim 1 wherein the locking member is generally rectangular in shape and wherein said axis is the longitudinal axis of the locking member.

3. The child resistant container construction of claim 1 wherein said peripheral lip is located at one end of the flexible plug.

4. The child resistant container construction of claim 1 wherein said rotatable locking member is provided with a knob to facilitate manually grasping it for rotation.

5. The child resistant container construction claim 1 wherein said means for preventing the entry of the plug into the container interior is defined by a retaining ring member which overlies and abuts the outer, external peripheral portion of the dispensing opening.

6. The child resistant container construction of claim 5 wherein said lift tab is integral with said retaining ring member, the lift tab extending radially beyond the dispensing opening.

7. The child resistant container construction of claim 1 wherein container interior dispensing opening is annularly continuous and wherein the plug peripheral lip is also annularly continuous.

8. A child resistant container construction, the combination of a container having a dispensing opening, a plug formed of flexible material, the plug having a peripheral lip normally engaging a portion of the internal rim of the dispensing opening to normally prevent the plug from being withdrawn from the dispensing opening in a direction away from the container interior, means carried by the plug to prevent its complete entry into the interior of the container, the plug having a radially disposed, manually graspable, lift tab carried by the plug, a locking member of a rigid material rotatably mounted in the plug, the locking member normally positioned on the plug to thereby prevent the plug from distorting sufficiently to allow its withdrawal from the dispensing opening upon pulling of the lift tab away from the container interior, the locking member being rotatable to a position wherein it can be temporarily removed from the plug.

9. The child resistant container construction of claim 8 wherein said locking member is provided with screw threads which mate with corresponding screw threads on the plug, whereby the locking member is temporarily removed from its normal position on top of the plug by unscrewing it from the plug.

10. The child resistant container construction of claim 8 wherein the locking member includes a plurality of radially outwardly extending arms angularly spaced from one another, the tip of each arm normally underlying a corresponding radially inwardly projecting abutment carried by the plug, the angular space between the abutments being of lesser width than the width of said outwardly extending arms, whereby the locking member is normally retained on the plug and can be temporarily removed from the plug by rotating it.

* * * * *